United States Patent [19]

Gillespie et al.

[11] Patent Number: 5,075,049

[45] Date of Patent: Dec. 24, 1991

[54] METHOD FOR IMPROVING SOLVENT CONTAINMENT

[75] Inventors: David W. Gillespie, Richmond; Ervin T. Powers, Jr., Midlothian, both of Va.; Bela M. Fabuss, Berwyn, Pa.

[73] Assignee: E. I. Du Pont de Nemours and Company, Wilmington, Del.

[21] Appl. No.: 580,522

[22] Filed: Sep. 11, 1990

[51] Int. Cl.[5] ..... D01D 5/11

[52] U.S. Cl. ..... 264/37; 264/205; 264/211.12; 264/211.14; 425/74; 425/75

[58] Field of Search ..... 264/37, 204, 205, 211.14, 264/211.12; 425/74, 75; 159/2.2; 202/182

[56] References Cited

U.S. PATENT DOCUMENTS

| | | | |
|---|---|---|---|
| 2,494,588 | 1/1950 | Skooglund | 425/74 |
| 2,763,892 | 9/1956 | Moos et al. | 425/74 |
| 3,504,076 | 3/1970 | Lee | 264/205 |
| 4,148,595 | 4/1979 | Bednarz | 425/75 |
| 4,193,967 | 3/1980 | Black | 55/213 |

*Primary Examiner*—Hubert C. Lorin

[57] ABSTRACT

A method of improving solvent vapor containment in a process for extruding a solvent-polymer mixture into a process vessel operated substantially at atmospheric pressure while continuously removing solvent vapor and polymer product from said process vessel is disclosed. The improvement involves connecting, by means of a passage, the process vessel with a containment tank, which containment tank is provided at the bottom thereof with means for solvent vapor removal and recovery. The top of the containment tank is provided with an atmospheric vent to ensure that the solvent vapor in the containment tank is at atmospheric pressure. The passage is further provided with a vapor siphon breaker to prevent siphoning of the solvent vapor from the containment tank back into the process vessel.

2 Claims, 1 Drawing Sheet

METHOD FOR IMPROVING SOLVENT CONTAINMENT

FIELD OF THE INVENTION

The present invention relates to an apparatus and method for controlling and virtually eliminating solvent vapor emissions from chemical process vessels that are operated at atmospheric pressure. More specifically, the invention relates to a chemical process vessel operated at atmospheric pressure wherein a containment tank is connected by a passage to the process vessel. The containment tank is provided with a vapor siphon breaker comprising an elongated vertically disposed tubular member having its upper end vented to the atmosphere and its lower end connected to the passage connecting the process vessel with the containment tank.

BACKGROUND OF THE INVENTION

There are many chemical processes that use solvents to form a final product. For instance, U.S. Pat. No. 3,504,076 (Lee), the contents of which are incorporated by reference herein, discloses a flash spinning cell in which large volumes of solvent are instantaneously vaporized and discharged into an essentially closed vessel. In a specific application, polyethylene is flash spun from a solution of trichlorofluoromethane, with the weight ratio of solvent to polymer being about 7 to 1. Due to the threat of ozone depletion in the earth's atmosphere, there is an increasing need to eliminate or minimize the venting of these vaporized solvents to the atmosphere.

In many other chemical processes, solvents are also used to assist in product formation. It is financially advantageous to minimize solvent loss by recovering, recycling and reusing the solvent. If the process is one that operates continuously, then a means must be provided to remove the product from the solvent-laden atmosphere where it was formed. This requires that the pressure in the region where the product is formed be at nearly atmospheric pressure, as this minimizes the force that pushes solvent out with the product. Furthermore, to operate safely, all vessels into which solvent is fed must have an overpressure protection device. For many atmospheric pressure vessels in processes, such as those described above, this consists of a stack that is open to the atmosphere and which vents any solvent vapors that can not be recovered to the environment. In instances when the solvent vapor recycling system fails, the entire solvent vapor content of the process may be discharged from the stack resulting in possible environmental harm and financial loss. In other cases, the filling and draining of the process vessel with solvent vapors can result in emissions directly through the stack.

In the past, containment of emissions from these stacks generally has been done by one of three methods: (1) a flare burned the vapors if the vapors were flammable; (2) a cold trap was installed to condense some of the vapors; or (3) a gas-holder was used to trap the vapors. Each of these methods is complicated and depends upon the proper functioning of mechanical parts. In addition, each has its own limitations. While a flare prevents environmental emissions by consuming energy constantly, it does not allow the vapor to be recycled and reused. A cold trap works only when the vapors have a high condensing point. If the vapors are mixed with a non-condensible gas, such as air, which frequently happens during vessel filling and draining, then the presence of the non-condensible gas dramatically reduces the recovery efficiency of the trap. A gas-holder operates on the process vessel pressure and does not allow the contained vapors to be isolated from the operating process. In addition, the pressure necessary to operate a gas-holder may be greater than the safe operating pressure of the process. A gas-holder also does not meet the requirements necessary for overpressure protection.

In accordance with the present invention, a containment system is provided for overcoming the limitations of each of the above-mentioned prior art methods for containing vapor emissions. The system utilizes an apparatus which contains no moving parts and requires no instrumentation to operate. The apparatus can work with any heavier-than-air vapor including the non-flammable vapors of halogenated chemicals. The apparatus can operate at atmospheric pressure and it does not generate back-pressure that could upset the process and cause the process vessel to rupture. In the preferred embodiment, the apparatus avoids significant mixing of the solvent vapors with the atmosphere which eases recovery of the vapors for reuse.

Other objects and advantages of the invention will become apparent to those skilled in the art upon reference to the attached drawing and to the detailed description of the invention which hereinafter follows.

SUMMARY OF THE INVENTION

The present invention provides an apparatus, and method for its use, wherein the overflow of heavier-than-air solvent vapor from chemical process vessels operated at atmospheric pressure is passed to a containment tank without allowing significant mixing of the solvent vapor overflow with the atmosphere. After the solvent vapor overflow has stopped, the solvent vapor is isolated in the containment tank without affecting the process being performed in the chemical process vessel. This is accomplished by maintaining the containment tank at atmospheric pressure by directly venting the tank to the atmosphere and by using a stand-pipe which is partially filled with solvent vapor from the chemical process vessel. During periods when the process vessel is at greater than atmospheric pressure, the containment tank is maintained at atmospheric pressure by using a vent having one end open to the atmosphere. The stand-pipe serves as a vapor siphon breaker for the passage connecting the process vessel with the containment tank.

The apparatus comprises a process vessel, adapted to be operated at substantially atmospheric pressure, fitted with means for injecting under pressure a product material and a vaporizable solvent for the product material. Means for continuously removing the product material from the process vessel and means adapted to remove vaporized solvent from the process vessel while maintaining the pressure in the pressure vessel substantially at atmospheric pressure are also provided.

A passage connecting the process vessel with a containment tank is provided wherein the containment tank has at the top thereof a vent to the atmosphere and means to remove the vaporized solvent from the containment tank. Additionally, a vapor siphon breaker is provided in communication with the passage connecting the process vessel with the containment tank. The vapor siphon breaker comprises a vertically disposed elongated passageway connected at its lower end to the passage and open to the atmosphere at its upper end.

The method relates to improving solvent vapor containment in a process comprising extruding under elevated pressure a mixture of solvent and polymer into a process vessel wherein polymer product is continuously removed from the process vessel and vaporized solvent is removed from the process vessel at a rate which maintains the pressure in the process vessel at substantially atmospheric pressure. The improvement comprises transferring solvent vapor through a passage from the process vessel to a containment tank; removing and recovering solvent vapor from the containment tank while venting the containment tank to the atmosphere to maintain the pressure therein at atmospheric pressure; and isolating the pressure in the process vessel from the pressure in the containment tank by means of a siphon breaker vented to the atmosphere that prevents solvent vapor from being siphoned back to the process vessel from the containment tank.

DETAILED DESCRIPTION OF THE PREFERRED EMBODIMENT

Figure 1:
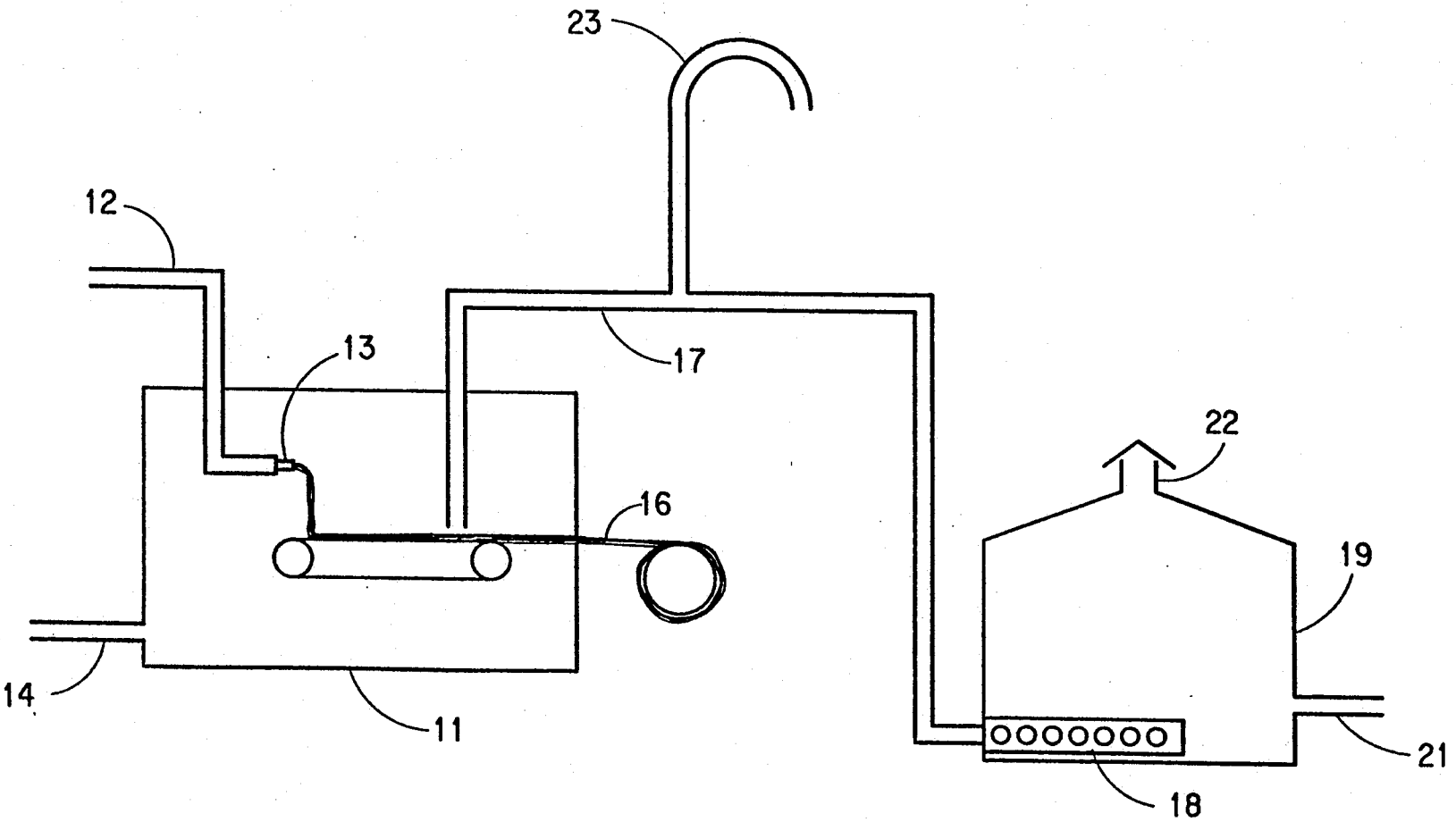
FIG. 1 is a schematic flow diagram depicting the apparatus and method of the present invention.

A preferred aspect of the present invention is a modification to and an improvement of the flash spinning cell as disclosed in U.S. Pat. No. 3,504,076 (Lee). In the Lee apparatus, large volumes of solvent are instantaneously discharged and vaporized into an essentially closed spin cell. In a specific application, polyethylene is flash spun from a solution of trichlorofluoromethane, and the ratio of the solvent weight to that of the polymer is about 7 to 1. It should be noted that the vapor density of trichlorofluoromethane is approximately 5 times that of dry air at the same temperature.

In steady state operation, polymer and solvent are injected into spin cell 11 through line 12 and nozzle 13. Solvent vapor is removed through line 14. The cell cannot be completely sealed because of the need to remove product sheet 16 and because of the force that even a small overpressure would exert on the walls of spin cell 11. The walls of spin cell 11 are sufficiently large that reinforcement to contain even one atmosphere overpressure is impractical. To prevent leakage of air into the cell, a slight positive pressure is maintained in the cell. This is done by controlling the pressure at 0 psig at the top of spin cell 11. Since the gas in spin cell 11 is heavier than air, the pressure everywhere, except at the top, is somewhat greater than atmospheric. In a typical case, the result is that the pressure at the bottom of 11 is about 100 pascals.

Air inside the spin cell 11 has a disturbing effect on electrostatic charging and laydown of the spun plexifilaments, and adversely affects recovery of the solvent vapor by compression and condensation. If any air is present, it will "float" on the heavier solvent vapor and will be present at the top of the spin cell unless turbulence in the spin cell has caused the air to be mixed with the solvent vapor.

If a process upset causes an overpressure condition, excess solvent vapor, in addition to that removed by line 14, flows through line 17 and manifold 18 into containment tank 19. The manifold 18 distributes the heavier solvent vapor along the bottom of containment tank 19 and reduces the tendency of the solvent vapor to mix with any air already in containment tank 19. Containment tank 19 is fitted with line 21 leading to a second solvent recovery system and with overflow vent 22 which is open to the atmosphere. Pressure communication between tank 19 and spin cell 11 is prevented by vapor siphon breaker 23. Without siphon breaker 23, the pressure control system for spin cell 11 would be affected by and respond directly to the level of solvent vapor in tank 19. As soon as the level of vapor in tank 19 became equal to the desired level in spin cell 11, the control system for spin cell 11 would believe that control had been restored and seek to match the flow out of spin cell 11 via line 14 to the incoming flow via solution supply 12.

In addition, the presence of siphon breaker 23 allows the solvent vapor that has been collected in tank 19 during an overpressure condition, to be recovered without affecting the pressure in spin cell 11. This occurs because as soon as the flow through overflow line 17 ceases, air flows down siphon breaker 23 into line 17. The pressure control system for spin cell 11 is then responding only to the level in spin cell 11. Thus, for pressure control purposes, siphon breaker 23 isolates tank 19 from spin cell 11. This condition allows tank 19 to be located at any elevation relative to spin cell 11 except that vent 22 must be lower in elevation than siphon breaker 23. Of added value is the fact that the pressure measurement in spin cell 11 always sees a high pressure during an overflow situation. Thereafter, removal of the contained solvent vapor from tank 19 can take place at the convenience of the operation.

Similarly, if a process upset causes an underpressure condition, solvent vapor could flow backward from tank 19 to spin cell 11 through line 17. As line 17 is emptied of solvent vapor, air will be drawn in through siphon breaker 23, and thus prevent the continuing drain of solvent vapor from tank 19 via siphoning.

The height of siphon breaker 23 is determined by the density of the solvent vapor being contained and the expected maximum flow rate through overflow line 17, which determines the pressure drop through line 17. To prevent loss of solvent vapor to the atmosphere through siphon breaker 23, its height must be such that if it were to be full of solvent vapor the static pressure head developed would be greater than the backpressure in line 17 due to the flow of solvent vapor through line 17. This means that there would be no pressure forcing the solvent vapor out of siphon breaker 23. In practice, the height should be set much higher than the theoretical value as the cost of doing so is minimal.

Although a particular embodiment of the present invention has been described in the foregoing description, it will be understood by those skilled in the art that the invention is capable of numerous modifications, substitutions and rearrangements without departing from the spirit or essential attributes of the invention. Reference should be made to the appended claims, rather than to the foregoing specification, as indicating the scope of the invention.

We claim:

1. A method for improving solvent vapor containment in a process comprising extruding under elevated pressure a mixture of solvent and polymer into a process vessel wherein polymer product is continuously removed from the process vessel and vaporized solvent is removed from the process vessel at a rate which maintains the pressure in the process vessel at substantially atmospheric pressure, the improvement comprising:

(a) transferring solvent vapor through a passage from the process vessel to a containment tank;
(b) removing and recovering solvent vapor from the containment tank while directly venting the containment tank to the atmosphere to maintain the pressure therein at atmospheric pressure; and
(c) isolating the vapor in the process vessel from the vapor in the containment tank by means of a siphon breaker open to the atmosphere to prevent solvent vapor from being siphoned back to the process vessel from the containment tank.

2. The method according to claim 1 wherein the solvent vapor being fed into the containment tank is distributed along the bottom of the containment tank.

* * * * *